US011505285B2

(12) United States Patent
Greco

(10) Patent No.: US 11,505,285 B2
(45) Date of Patent: Nov. 22, 2022

(54) BOAT DOCK MOORING SYSTEM

(71) Applicant: Joseph Greco, Asbury, NJ (US)

(72) Inventor: Joseph Greco, Asbury, NJ (US)

( * ) Notice: Subject to any disclaimer, the term of this patent is extended or adjusted under 35 U.S.C. 154(b) by 10 days.

(21) Appl. No.: 17/155,192

(22) Filed: Jan. 22, 2021

(65) Prior Publication Data

US 2022/0234689 A1 Jul. 28, 2022

(51) Int. Cl.
*B63B 21/20* (2006.01)
*B63B 21/04* (2006.01)
*B63B 21/00* (2006.01)

(52) U.S. Cl.
CPC ..... *B63B 21/20* (2013.01); *B63B 21/045* (2013.01); *B63B 2021/001* (2013.01); *B63B 2021/005* (2013.01)

(58) Field of Classification Search
CPC . B63B 21/20; B63B 21/045; B63B 2021/001; B63B 2021/005
See application file for complete search history.

(56) References Cited

U.S. PATENT DOCUMENTS 3,224,404 A * 12/1965 De Jong ..... B63B 21/54 114/230.25
3,817,507 A * 6/1974 Derman ..... E04H 15/32 267/74
3,878,808 A * 4/1975 Mock, Jr. ..... B63B 21/54 114/221 R
4,192,493 A * 3/1980 Koughan ..... F16F 9/0418 267/74
4,649,850 A * 3/1987 Akiba ..... E01D 15/24 114/230.23
4,667,617 A * 5/1987 Molitor ..... B63B 21/54 114/230.25
4,754,957 A * 7/1988 Muttart ..... B63B 21/00 114/230.22
4,864,956 A * 9/1989 Onstwedder, Jr. ..... B63B 21/20 267/74
5,586,514 A * 12/1996 Yuscavage ..... B63B 21/54 114/221 R
5,694,879 A * 12/1997 Taylor ..... B63B 21/04 267/74
5,832,861 A * 11/1998 Taylor ..... B63B 21/04 267/74
5,906,173 A * 5/1999 Day, Jr. ..... B63B 21/20 114/294
6,205,944 B1 * 3/2001 Dierksen ..... B63B 21/00 114/230.1
6,273,017 B1 * 8/2001 Griffin ..... B63B 21/54 114/221 R
6,345,583 B1 * 2/2002 Thackston ..... F16F 1/128 267/74
6,962,122 B1 * 11/2005 Bouldin, Jr. ..... B63B 21/00 114/230.17

(Continued)

FOREIGN PATENT DOCUMENTS

GB 2426965 8/2007

*Primary Examiner* — S. Joseph Morano
*Assistant Examiner* — Jovon E Hayes
(74) *Attorney, Agent, or Firm* — Votta Law Group

(57) ABSTRACT

A boat mooring system utilizing a cylinder having an internal spring-like mechanism that allows a retaining rope to lengthen or shorten automatically to adjust for rising tide or high wind to retain a boat at a safe distance from a dock or pier.

4 Claims, 6 Drawing Sheets

(56) References Cited

U.S. PATENT DOCUMENTS

| | | | | |
|---|---|---|---|---|
| 8,342,116 | B1 * | 1/2013 | Cardarelli | B63B 21/54<br>114/221 R |
| 9,045,198 | B2 * | 6/2015 | Philips | B63B 21/04 |
| 10,946,936 | B2 * | 3/2021 | Miller | B65H 57/12 |
| 2012/0228891 | A1 * | 9/2012 | Howard | B63B 21/04<br>114/221 R |
| 2021/0371051 | A1 * | 12/2021 | Givens | B63B 21/00 |

* cited by examiner

BOAT DOCK MOORING SYSTEM

BACKGROUND

1. Field

One or more embodiments of the present invention relate to an apparatus for mooring a boat. In particular, the present invention relates to a shock absorbing, fixed-arm apparatus that is configured to prevent the boat from hitting the dock or pier while alleviating stress induced cracks in the boat when moored.

2. Description of the Related Art

Boats are secured to permanent structures through the use of a mooring. The purpose of the mooring is to prevent free movement of the boat in the water. Generally, a boat is considered docked whenever a mooring line is attached from the boat to a jetty or pier.

Several systems have been proposed in the past to secure a boat to a wharf, pier, or jetty. One such system relies on the use of thick ropes or mooring lines which are attached to the boat and secured to a fitting on the pier or wharf. The mooring lines or ropes are typically constructed of a synthetic material, such as nylon. These synthetic lines are easy to work with but are highly elastic. If these elastic lines become highly stressed, the lines could break resulting in considerable property damage or bodily injury. These lines also require adjustment to compensate for rising and lowering sea levels due to tides.

Another system for mooring boats uses a combination of flexible poles, typically constructed of fiberglass, and mooring lines to assist in protecting boats against dockside damage. These systems are commonly referred to as Mooring Whips and are configured to prevent a boat from hitting a dock by pulling the boat a safe distance away from the dock. These Mooring Whip systems require a constant tension in the flexible poles in order for them to maintain the safe distance away from the dock. However, when tides rise, the Mooring Whip systems become less effective as a sufficient tension in the poles is not maintained. The Mooring Whip system also does not sufficiently prevent a boat from hitting a dock when confronted with high winds or relatively large wakes.

U.S. Pat. No. 6,273,017 discloses another boat mooring device configured to secure a boat to a securing object using a length of PVC pipe and loose rope. However, the disclosed device does not retain the boat taught against the securing object and will likely result in the boat hitting the dock under adverse conditions. Also, the device does not automatically adjust to wind and water conditions to keep the boat a safe distance from the dock or pier.

Other boat mooring devices are disclosed in U.S. Pat. Nos. 6,205,944, 5,586,944, and 4,864,956. However, none of these devices are able to retain a boat taught against a securing object or automatically adjust to wind and water conditions to keep the boat a safe distance from the dock or pier.

Therefore, what is needed is a boat dock mooring system that incorporates a mechanism that adjusts to wind and water conditions to retain a boat a safe distance from a dock or pier.

SUMMARY

In view of what is known in the art, the inventor has developed a boat mooring system that does not rely on the loose ropes included in the previous attempts at configuring boat mooring devices and automatically adjusts to wind and water conditions to prevent a boat from hitting a dock or pier during adverse conditions. The present boat mooring system utilizes a cylinder having an internal spring-like mechanism that allows the retaining rope to lengthen or shorten automatically to adjust for rising tide or high wind to retain the boat at a safe distance from the dock or pier.

In one embodiment, the boat dock mooring system comprises a spring-like mechanism that expands and contracts with the tide, wake, and wind. The spring-like mechanism comprises a solid rubber bungee having a dock line wrapped around itself wherein the solid rubber bungee is secured at both ends with a stainless-steel fastener. The dock line wrapped around the rubber bungee are housed inside a solid tube or pipe of sufficient width and length to retain the boat at a safe distance from the dock.

It is envisaged that one end of the boat dock mooring system will be attached to the boat cleat and the opposite end attached to the dock cleat or wrapped around a piling.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Reference will now be made in detail to embodiments, examples of which are illustrated in the accompanying drawings. In this regard, the present embodiments may have different forms and should not be construed as being limited to the descriptions set forth herein. Accordingly, the embodiments are merely described below, by referring to the figures, to explain aspects of the present invention.

Figure 1:
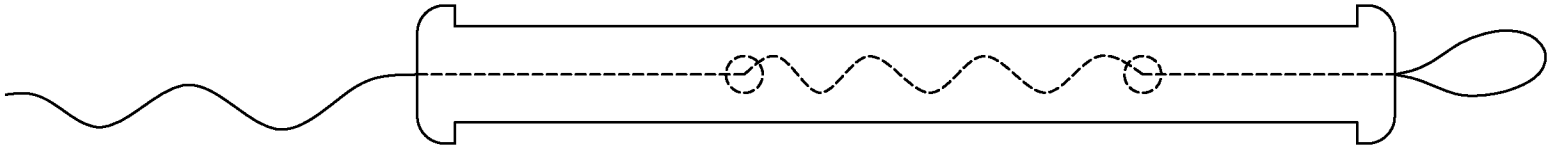
FIG. 1 is a schematic of the boat dock mooring system depicting the spring-like mechanism inside the solid tube.

As shown in FIG. 1, the present boat dock mooring system is an apparatus comprising a pipe or tube 100; a solid rubber bungee 204; dock line 202; and fasteners 102 on either end of the pipe or tube. The dock line is wrapped around the solid rubber bungee in a spiral fashion. Both the dock line and the solid rubber bungee together constitute a spring-like mechanism 200. The entire spring-like mechanism is housed inside the pipe or tube 100.

Figure 6:
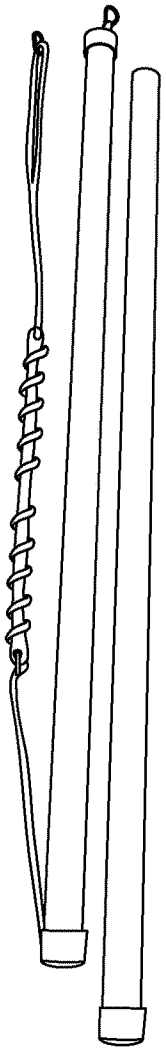
FIG. 6 is a drawing of the spring-like mechanism removed from the pipe.

Also, as shown in FIG. 6, the rubber bungee 204 may comprise eyelets on either end through which the dock line may be threaded on one end as the dock line is wrapped around the bungee and as the line exits the bungee. This configuration provides the spring-like mechanism necessary for retaining the boat a safe distance from the dock or pier. The eyelets may be constructed of any suitable material for marine and stress applications.

Figure 5:
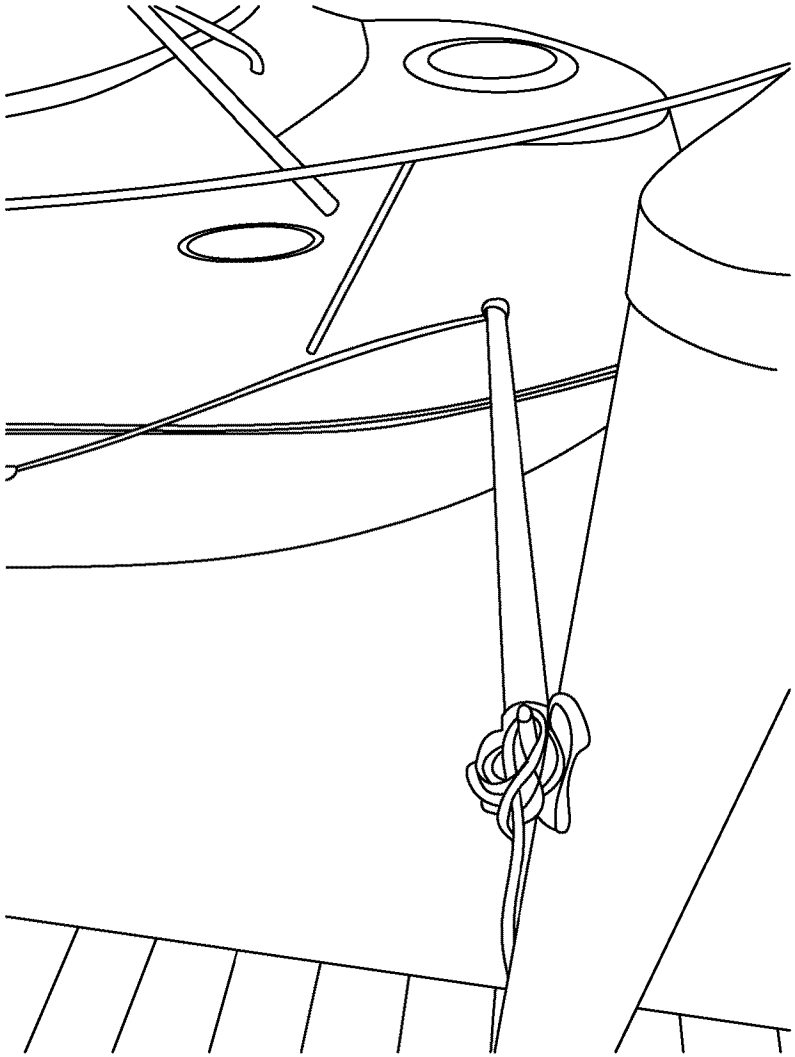
FIG. 5 is a drawing of the boat dock mooring device having one end attached to a secure point on a pier and the opposite end attached to a boat.

In one embodiment, as shown in FIGS. 5 and 6, the pipe or tube comprises end caps 104 fitted on both ends. The end caps may be constructed of any suitable material including, but not limited to, rubber, pvc, plastic, or stainless steel. The end caps may further be covered in leather or other suitable material to protect the boat from damage due to incidental contact with the boat dock mooring system.

In another embodiment, the boat dock mooring system comprises fasteners 102 on the ends of the spring-like mechanism. These fasteners 102 may be any suitable fastener or shackle that will permit attachment of a suitable dock line to the spring-like mechanism.

The pipe or tube 100 of the boat dock mooring system may be any suitable pipe or tube constructed of any suitable material for marine applications. The length of the pipe or tube is customizable to the size of the boat and the characteristics of the dock or pier cleat or piling. It is envisaged that the pipe or tube diameter and length will be sufficient to maintain a boat a safe distance from the dock or pier during various tide, wide or wake conditions.

The solid rubber bungee 204 of the boat dock mooring system may be any suitable elasticized rubber cord compatible with marine applications. It is envisaged that the solid rubber bungee 204 may be of a length and thickness sufficient to fit inside the pipe or tube 100 along with the dock line 202 wrapped in a spiral fashion along its length.

A method for mooring a boat using the present boat dock mooring system comprises attaching one end of the apparatus to a boat cleat, and then attaching the opposite end to a dock cleat or piling. Prior to attaching the apparatus to the dock, the dock line is pulled snuggly reducing any slack in the spring-like mechanism. Once all the slack has been removed, one last tug is used to stretch the internal mechanism slightly. Once the internal mechanism is engaged, the dock line is then attached to the dock cleat or wrapped around the piling.

Figure 2:
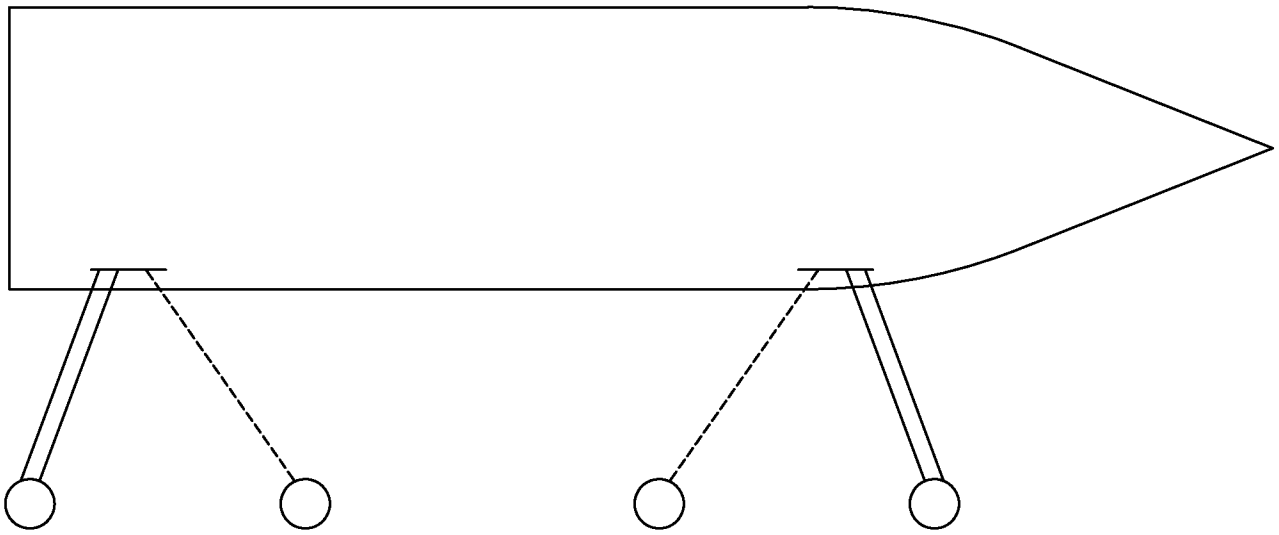
FIG. 2 is a depiction of use of the boat dock mooring system of FIG. 1 in a capital Lambda shaped configuration.
Figure 3:
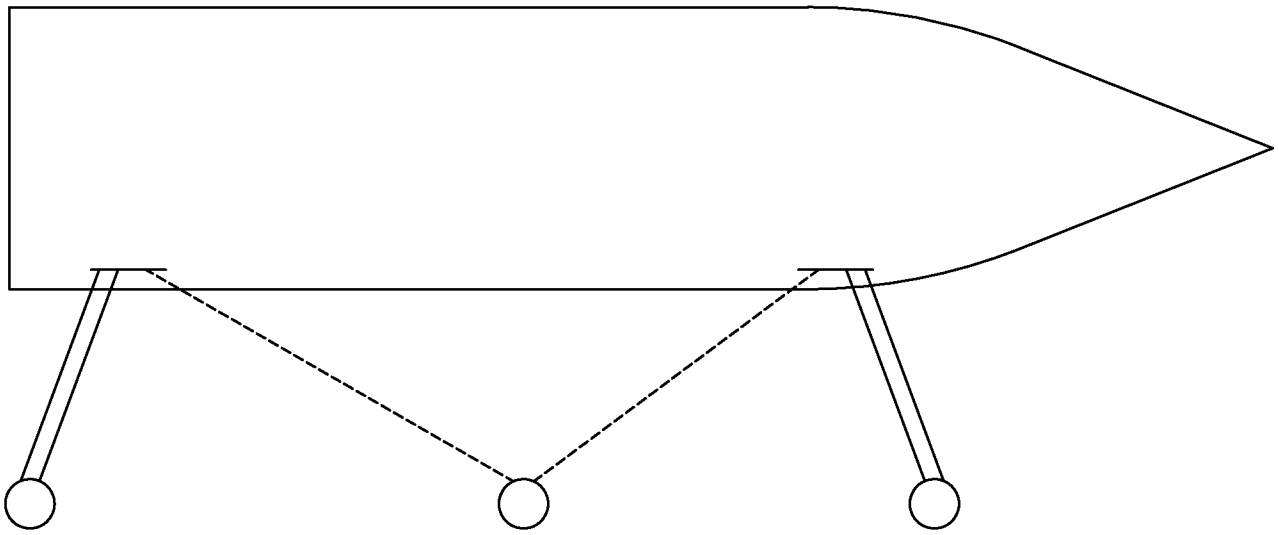
FIG. 3 is a depiction of use of the boat dock mooring system of FIG. 1 in a capital Mu shaped configuration.
Figure 4:
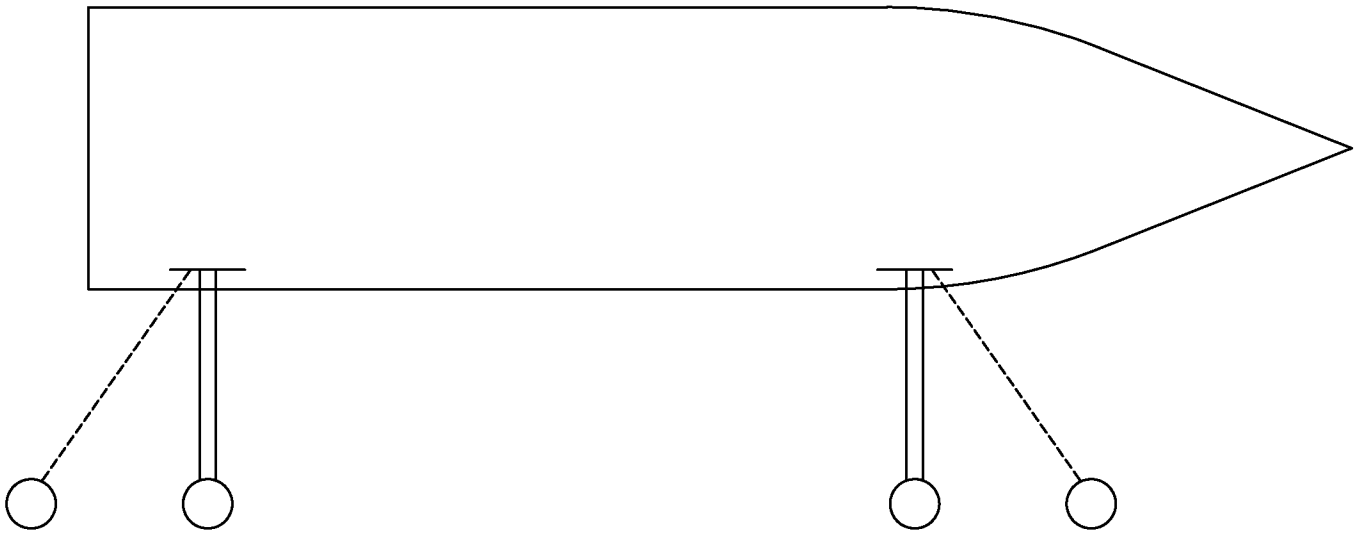
FIG. 4 is a depiction of use of the boat dock mooring system of FIG. 1 in an alternate Lambda shaped configuration.

It is envisaged that for optimum performance two apparatuses should be utilized simultaneously, as shown in FIGS. 2, 3 and 4. In one embodiment, A single apparatus would be attached toward the bow and another apparatus toward the stern, while using two additional lines creating a functional system keeping the boat a safe distance from the dock in rising tides and sustained winds.

The foregoing descriptions of specific embodiments of the present invention have been presented for purposes of illustration and description. They are not intended to be exhaustive or to limit the invention and method of use to the precise forms disclosed. It is understood that many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient but is intended to cover the application or implementation without departing from the spirit or scope of the claims of the present invention.

The invention claimed is:

1. A boat dock mooring system comprising an apparatus wherein the apparatus comprises: a pipe having a boat cleat end and a dock cleat end; a dock line having a first and second end; a pair of pipe caps on the ends of the pipe, each of the pair of caps having a through hole; a spring mechanism having a pair fasteners at opposite ends, the spring mechanism being housed inside the pipe and a dock line attached to each fastener between the first and second ends of the dock line; wherein the first end exits the pipe at the boat cleat end and the second end exists the pipe at the dock cleat end with the dock line passing through each through hole in each pipe cap; and wherein the dock line and a solid rubber bungee together constitute the spring mechanism in which the dock line is wrapped around the solid rubber bungee in a spiral fashion.

2. The apparatus of claim 1 wherein the spring mechanism comprises a solid rubber bungee having eyelets on both ends the eyelets being the dock line fasteners on the spring mechanism.

3. The apparatus of claim 2 wherein the dock line is wrapped in a spiral fashion around the spring mechanism between the eyelets at each end of the spring mechanism.

4. A method for mooring a boat comprises attaching one end of at least one of the apparatuses of claim 1 to a boat cleat; pulling the dock line snuggly to reduce slack in the spring mechanism; and then attaching the opposite end to a dock cleat or piling; wherein the dock line and a solid rubber bungee together constitute the spring mechanism in which the dock line is wrapped around the solid rubber bungee in a spiral fashion.

* * * * *